US007775284B2

(12) United States Patent
Richards et al.

(10) Patent No.: US 7,775,284 B2
(45) Date of Patent: Aug. 17, 2010

(54) APPARATUS FOR ADJUSTABLY CONTROLLING THE INFLOW OF PRODUCTION FLUIDS FROM A SUBTERRANEAN WELL

(75) Inventors: William Mark Richards, Frisco, TX (US); Jean Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 115 days.

(21) Appl. No.: 11/904,771

(22) Filed: Sep. 28, 2007

(65) Prior Publication Data

US 2009/0084556 A1 Apr. 2, 2009

(51) Int. Cl.
*E03B 3/18* (2006.01)
*E21B 34/00* (2006.01)

(52) U.S. Cl. ..... 166/329; 166/227; 166/316

(58) Field of Classification Search ..... 166/56, 166/227, 235, 236, 157, 91.1
See application file for complete search history.

(56) References Cited

U.S. PATENT DOCUMENTS

| | | | | |
|---|---|---|---|---|
| 148,387 | A | 3/1874 | Squires | |
| 1,536,348 | A | 12/1921 | Mack | |
| 2,517,841 | A | 8/1950 | Chenault | |
| 2,602,516 | A | 7/1952 | Gray | |
| 5,320,178 | A | 6/1994 | Cornette | |
| 5,337,808 | A | 8/1994 | Graham | |
| 5,435,393 | A | 7/1995 | Brekke et al. | |
| 5,803,179 | A | 9/1998 | Echols et al. | |
| 5,812,331 | A | 9/1998 | Lopez et al. | |
| 5,896,928 | A * | 4/1999 | Coon | 166/373 |
| 6,112,815 | A | 9/2000 | Bøe et al. | |
| 6,112,817 | A * | 9/2000 | Voll et al. | 166/370 |
| 6,343,651 | B1 | 2/2002 | Bixenman | |
| 6,371,210 | B1 | 4/2002 | Bode et al. | |
| 6,470,749 | B1 | 10/2002 | Han et al. | |

(Continued)

FOREIGN PATENT DOCUMENTS

| | | | |
|---|---|---|---|
| GB | 2421746 | A | 7/2006 |

(Continued)

OTHER PUBLICATIONS

PCT International Search Report and Written Opinion, Apr. 27, 2009.

*Primary Examiner*—Kenneth Thompson
*Assistant Examiner*—James G Sayre
(74) *Attorney, Agent, or Firm*—Lawrence R. Youst

(57) ABSTRACT

A flow control apparatus (800) includes a tubular member (818) having a plurality of openings (820, 822, 824, 826) that allow fluid flow between an exterior and an interior flow path (828) of the tubular member (818) and a multi-stage flow restricting section (804) operably positioned in a fluid flow path between a fluid source disposed exteriorly of the tubular member (818) and the interior flow path (828). The flow restricting section (804) including a plurality of flow restricting devices (838, 844, 850) each operable to create a pressure drop. Actuatable devices (830, 832, 834, 836) operably associated with the openings (820, 822, 824, 826) are sequentially actuatable to allow fluid flow through the associated openings (820, 822, 824, 826), thereby sequentially reducing the pressure drop experienced by fluids flowing from the fluid source to the interior flow path (828).

13 Claims, 9 Drawing Sheets

U.S. PATENT DOCUMENTS

| | | | | |
|---|---|---|---|---|
| 6,622,794 | B2 | 9/2003 | Zisk, Jr. | |
| 6,644,412 | B2 | 11/2003 | Bode et al. | |
| 6,719,051 | B2 | 4/2004 | Hailey, Jr. et al. | |
| 6,786,285 | B2 | 9/2004 | Johnson et al. | |
| 6,857,476 | B2 | 2/2005 | Richards | |
| 6,883,613 | B2 | 4/2005 | Bode et al. | |
| 6,886,634 | B2 * | 5/2005 | Richards | 166/278 |
| 6,899,176 | B2 | 5/2005 | Hailey, Jr. et al. | |
| 7,055,598 | B2 | 6/2006 | Ross et al. | |
| 7,096,945 | B2 | 8/2006 | Richards et al. | |
| 7,100,686 | B2 | 9/2006 | Wittrisch | |
| 7,152,688 | B2 | 12/2006 | Richards | |
| 7,185,706 | B2 | 3/2007 | Freyer | |
| 7,191,833 | B2 | 3/2007 | Richards | |
| 7,204,316 | B2 | 4/2007 | Dusterhoft et al. | |
| 7,252,153 | B2 | 8/2007 | Hejl et al. | |
| 7,413,022 | B2 | 8/2008 | Broome et al. | |
| 7,426,962 | B2 | 9/2008 | Moen et al. | |
| 7,537,056 | B2 | 5/2009 | MacDougall | |
| 2004/0149435 | A1 * | 8/2004 | Henderson | 166/250.15 |
| 2006/0186601 | A1 | 8/2006 | Lopez | |
| 2007/0012444 | A1 | 1/2007 | Horgan et al. | |
| 2007/0039741 | A1 * | 2/2007 | Hailey, Jr. | 166/376 |
| 2007/0246210 | A1 | 10/2007 | Richards | |
| 2007/0246213 | A1 | 10/2007 | Hailey, Jr. | |
| 2007/0246407 | A1 * | 10/2007 | Richards et al. | 210/97 |
| 2008/0035330 | A1 | 2/2008 | Richards | |
| 2008/0041580 | A1 | 2/2008 | Freyer et al. | |
| 2008/0041581 | A1 | 2/2008 | Richards | |
| 2008/0041588 | A1 | 2/2008 | Richards et al. | |
| 2008/0283238 | A1 * | 11/2008 | Richards et al. | 166/228 |
| 2008/0314590 | A1 * | 12/2008 | Patel | 166/278 |
| 2009/0000787 | A1 | 1/2009 | Hill et al. | |
| 2009/0065199 | A1 * | 3/2009 | Patel et al. | 166/250.01 |
| 2009/0084556 | A1 | 4/2009 | Richards et al. | |
| 2009/0133869 | A1 | 5/2009 | Clem | |
| 2009/0133874 | A1 | 5/2009 | Dale et al. | |
| 2009/0133875 | A1 | 5/2009 | Tibbles et al. | |
| 2009/0133882 | A1 | 5/2009 | Delaloye et al. | |
| 2009/0151925 | A1 | 6/2009 | Richards et al. | |

FOREIGN PATENT DOCUMENTS

| | | |
|---|---|---|
| GB | 2455001 | 7/2009 |
| WO | WO 02/075110 A1 | 9/2002 |
| WO | 2004018837 A1 | 3/2004 |
| WO | 2009048822 | 4/2009 |
| WO | 2009048823 | 4/2009 |
| WO | 2009065793 | 5/2009 |
| WO | 2009065890 | 5/2009 |
| WO | 2009066097 | 5/2009 |
| WO | 2009067021 | 5/2009 |

* cited by examiner

APPARATUS FOR ADJUSTABLY CONTROLLING THE INFLOW OF PRODUCTION FLUIDS FROM A SUBTERRANEAN WELL

TECHNICAL FIELD OF THE INVENTION

This invention relates, in general, to controlling the production of fluids from a well that traverses a hydrocarbon bearing subterranean formation and, in particular, to an apparatus for controlling the inflow of production fluids from the subterranean well that is adjustable over the life of the well.

BACKGROUND OF THE INVENTION

Without limiting the scope of the present invention, its background will be described with reference to producing fluid from a subterranean formation, as an example.

During the completion of a well that traverses a hydrocarbon bearing subterranean formation, production tubing and various equipment are installed in the well to enable safe and efficient production of the formation fluids. For example, to prevent the production of particulate material from an unconsolidated or loosely consolidated subterranean formation, certain completions include one or more sand control screens positioned proximate the desired production intervals. In other completions, to control the flow rate of production fluids into the production tubing, it is common practice to install one or more fluid flow control devices within the tubing string.

Recently, attempts have been made to utilize fluid flow control devices within completions requiring sand control. While certain benefits have been achieved through the use of such devices, many of these devices are complicated to operate and have suffered from poor reliability. In addition, it has been found that during the life of the well, as the formation depletes and reservoir pressure decreases, the flow control characteristics of many such fluid flow control devices may not remain suitable for achieving the desired production goals, particularly in long horizontal intervals.

Accordingly, need has arisen for a fluid flow control device for controlling the inflow of formation fluids in a completion requiring sand control. A need has also arisen for such a fluid flow control device that is reliable in a variety of flow conditions. Further, a need has arisen for such a fluid flow control device that can be used throughout the life of the well.

SUMMARY OF THE INVENTION

The present invention disclosed herein comprises a fluid flow control apparatus for controlling the inflow of formation fluids. The fluid flow control apparatus of the present invention is reliable in a variety of flow conditions. In addition, the fluid flow control apparatus of the present invention can be used throughout the life of the well and may be used in conjunction with a filter medium to serve as a sand control screen with flow control capabilities.

In one aspect, the present invention is directed to a sand control screen that is positionable within a wellbore. The sand control screen includes a base pipe having at least one opening that allows fluid flow between an exterior of the base pipe and an interior flow path of the base pipe. A filter medium is positioned exteriorly of the base pipe. An actuatable device is operably associated with the at least one opening. The actuatable device is operable to initially prevent fluid flow through the at least one opening and is actuatable to allow fluid flow through the at least one opening. In one embodiment, the actuatable device is a pressure actuated device that is actuated responsive to an increase in pressure to a predetermined level in the interior flow path. For example, the pressure actuated device may be a rupture disk.

In another aspect, the present invention is directed to a sand control screen that includes a base pipe having at least one opening that allows fluid flow between an exterior of the base pipe and an interior flow path of the base pipe. A filter medium is positioned exteriorly of the base pipe. A flow restricting device is disposed in a fluid flow path between the filter medium and the at least one opening. An actuatable device is operably associated with the at least one opening. In this embodiment, the flow restricting device is operable to create a pressure drop in fluids flowing therethrough. In addition, the actuatable device is operable to initially prevent fluid flow through the at least one opening and is actuatable to allow fluid flow through the at least one opening.

In yet another aspect, the present invention is directed to a sand control screen that includes a base pipe having at least one opening that allows fluid flow between an exterior of the base pipe and an interior flow path of the base pipe. A filter medium is positioned exteriorly of the base pipe. A one way valve is disposed in a fluid flow path between the filter medium and the at least one opening. An actuatable device is operably associated with the at least one opening. In this embodiment, the one way valve is operable to allow fluid flow in a downstream direction from the filter medium to the at least one opening and to prevent fluid flow in an upstream direction from the at least one opening to the filter medium. In addition, the actuatable device is operable to initially prevent fluid flow through the at least one opening and is actuatable to allow fluid flow through the at least one opening.

In a further aspect, the present invention is directed to a sand control screen that includes a base pipe having at least one opening that allows fluid flow between an exterior of the base pipe and an interior flow path of the base pipe. A filter medium is positioned exteriorly of the base pipe. A flow restricting device and a one way valve are disposed in a fluid flow path between the filter medium and the at least one opening. An actuatable device is operably associated with the at least one opening. In this embodiment, the flow restricting device is operable to create a pressure drop in fluids flowing therethrough, the one way valve is operable to allow fluid flow in a downstream direction from the filter medium to the at least one opening and prevent fluid flow in an upstream direction from the at least one opening to the filter medium and the actuatable device is operable to initially prevent fluid flow through the at least one opening and is actuatable to allow fluid flow through the at least one opening. Also in this embodiment, the flow restricting device may be upstream or downstream of the one way valve or the flow restricting device and the one way valve may be integrally formed.

In another aspect, the present invention is directed to a flow control apparatus for controlling the inflow of production fluids from a subterranean well. The flow control apparatus includes a tubular member having a plurality of openings that allow fluid flow between an exterior of the tubular member and an interior flow path of the tubular member. The flow control apparatus also includes a multi-stage flow restricting section that is operably positioned in a fluid flow path between a fluid source disposed exteriorly of the tubular member and the interior flow path. The flow restricting section includes a plurality of flow restricting devices each of which is operable to create a pressure drop and each of which is associated with one of the openings creating a plurality of flow paths between the fluid source and the interior flow path via the respective openings. Actuatable devices are operably associated with at least some of the openings. Each of the acutatable devices initially prevents fluid flow through the associated opening and is actuatable to allow fluid flow through the associated opening to sequentially reduce the pressure drop experienced by fluids flowing from the fluid source to the interior flow path.

In one embodiment of the fluid flow control apparatus, at least some of the flow restricting devices include one way valve capabilities to prevent fluid flow from the flow restricting section to the fluid source. In another embodiment, the fluid flow control apparatus includes a filter medium disposed exteriorly of the tubular member between the fluid source and the multi-stage flow restricting section.

In yet another aspect, the present invention is directed to a sand control screen that includes a base pipe having first and second openings that allow fluid flow between an exterior of the base pipe and an interior flow path of the base pipe. A filter medium and a flow restricting section are disposed exteriorly of the base pipe. The flow restricting section including first and second flow restricting devices that respectively create first and second pressure drops in fluids flowing therethrough. The first flow restricting device provides a first flow path between the filter medium and the interior flow path via the first opening. The first and second flow restricting devices provide a second flow path between the filter medium and the interior flow path via the second opening. An actuatable device is operably associated with the first opening. The actuatable device is operable to initially prevent fluid flow through the first opening and is actuatable to allow fluid flow through the first opening. In this manner, fluid flow through the flow restricting section is adjustable from the second flow path to the first flow path which reduces the pressure drop associated with fluid flow through the flow restricting section.

In one embodiment of the sand control screen, an actuatable device operably associated with the second opening initially prevents fluid flow through the second opening and is actuatable to allow fluid flow through the second opening. Additionally or alternatively, a one way valve may be associated with one or both of the flow restricting devices to prevent fluid flow from the flow restricting section to the filter medium.

In a further aspect, the present invention is directed to a sand control screen that includes a base pipe having first, second and third openings that allow fluid flow between an exterior of the base pipe and an interior flow path of the base pipe. A filter medium and a flow restricting section are disposed exteriorly of the base pipe. The flow restricting section including first, second and third flow restricting devices that respectively create first, second and third pressure drops in fluids flowing therethrough. The first flow restricting device provides a first flow path between the filter medium and the interior flow path via the first opening. The first and second flow restricting devices provide a second flow path between the filter medium and the interior flow path via the second opening. The first, second and third flow restricting devices provide a third flow path between the filter medium and the interior flow path via the third opening. First and second actuatable devices are operably associated with the first and second openings. The first and second actuatable devices are operable to initially prevent fluid flow through the first and second opening, respectively and are actuatable to allow fluid flow through the first and second openings, respectively. The second actuatable device may be a pressure actuated device that is actuated responsive to an increase in pressure to a first predetermined level in the interior flow path. The first actuatable device may also be a pressure actuated device that is actuated responsive to an increase in pressure to a second and higher predetermined level in the interior flow path. In this manner, fluid flow through the flow restricting section is adjustable from the third flow path to the second flow path and then to the first flow path, thereby progressively reducing the pressure drop associated with fluid flow through the flow restricting section.

In one embodiment, each of the flow restricting devices also has a one way valve associated therewith that prevents fluid flow from the flow restricting section to the filter medium. Also in this embodiment, the base pipe may include a fourth opening that allows fluid flow between the exterior of the base pipe and the interior flow path of the base pipe and provides a fourth flow path that bypasses the first, second and third flow restricting devices. In this configuration, an actuatable device is operably associated with the fourth opening that is operable to initially prevent fluid flow through the fourth opening and is actuatable to allow fluid flow through the fourth opening, thereby bypassing the first, second and third flow restricting devices.

In another aspect, the present invention is directed to a one way valve that includes a substantially tubular outer housing and a ball cage disposed within the outer housing. The ball cage has a substantially tubular member that defines an internal flow passageway. An annular flange extends radially outwardly from the tubular member and has a plurality of passageways extending longitudinally therethrough. An annular retainer flange extends radially outwardly from the tubular member. A plurality of longitudinally extending tracks disposed relative to an outer surface of the tubular member and extend between the annular flange and the annular retainer flange. A plurality of balls are disposed within an annular region defined by the outer housing, the outer surface of tubular member, the annular flange and the annular retainer flange. Each of the balls corresponds with one of the tracks such that the balls are allowed to travel longitudinally within the tracks but are prevented from traveling circumferentially within the annular region outside of the corresponding tracks.

In one configuration, the balls are remote from the passageways to allow fluid flow through the one way valve in a first direction. In another configuration, the balls seat relative to the passageways to prevent fluid flow through the one way valve in a second direction.

In one embodiment, each of the tracks has a substantially uniform circumferential width along its longitudinal length. In another embodiment, each of the tracks has a greater circumferential width proximate the annular retainer flange as compared to its circumferential width proximate the annular flange.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
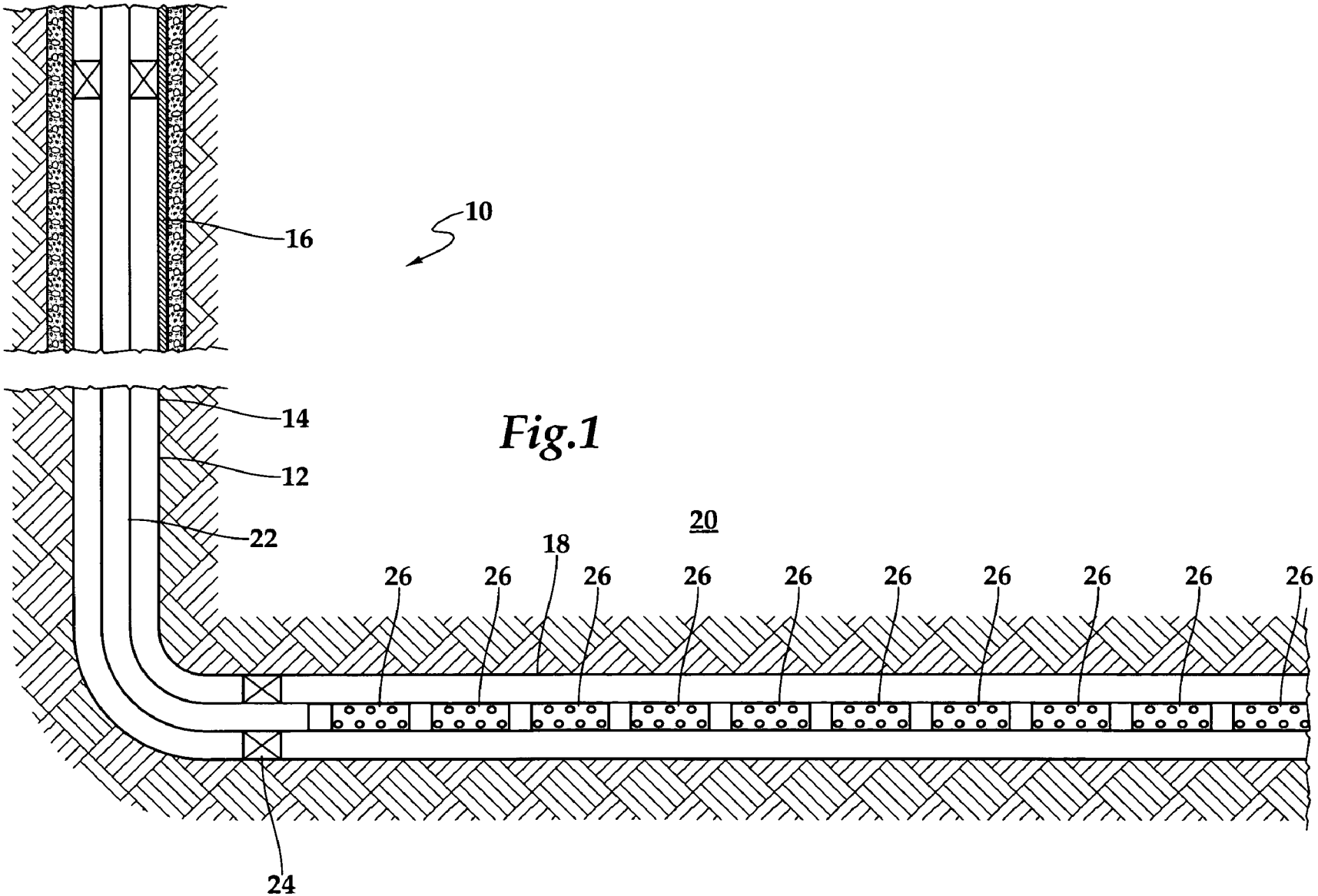
FIG. 1 is a schematic illustration of a well system operating a plurality of fluid flow control devices according to the present invention.

Referring initially to FIG. 1, therein is depicted a well system including a plurality of fluid flow control devices embodying principles of the present invention that is schematically illustrated and generally designated 10. In the illustrated embodiment, a wellbore 12 extends through the various earth strata. Wellbore 12 has a substantially vertical section 14, the upper portion of which has installed therein a casing string 16.

Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. Positioned within tubing string 22 is a seal assembly 24 and a plurality of fluid flow control devices 26. Through use of the fluid flow control devices 26 of the present invention, control over the flow rate and composition of the produced fluids is enabled. For example, by choking production from the entire producing interval, a more uniform production profile from the entire interval is achievable. Specifically, if production from formation 20 were allowed without downhole choking, a majority of the production into tubing string 22 would come from the portion of formation 20 near the heel of the well with little contribution from the portion of formation 20 near the toe of the well. This scenario can result in premature water encroachment as the desired fluids from the portion of formation 20 near the heel depletes.

By incorporating one or more fluid restricting devices in each fluid flow control device 26 of the present invention, a more uniform production profile along the entire length of substantially horizontal section 18 can be achieved. In addition, in those embodiments having more than one fluid restricting device in series within each fluid flow control device 26, the uniform production profile can be maintained for the life of the well as the pressure drop associated with fluid flow control devices 26 can be adjusted over time.

In the illustrated embodiment, each of the fluid flow control devices 26 provides not only fluid flow control capability but also sand control capability. The sand control screen elements or filter media associated with fluid flow control devices 26 are designed to allow fluids to flow therethrough but prevent particulate matter of sufficient size from flowing therethrough. The exact design of the screen element associated with fluid flow control devices 26 is not critical to the present invention as long as it is suitably designed for the characteristics of the formation fluids and any treatment operations to be performed. For example, the sand control screen may utilize a nonperforated base pipe having a wire wrapped around a plurality of ribs positioned circumferentially around the base pipe that provide stand off between the base pipe and the wire wrap. Alternatively, a fluid-porous, particulate restricting, metal material such as a plurality of layers of a wire mesh that are sintered together to form a fluid porous wire mesh screen could be used as the filter medium. As illustrated, a protective outer shroud having a plurality of perforations therethrough may be positioned around the exterior of the filter medium.

Even though FIG. 1 depicts the fluid flow control devices of the present invention in an open hole environment, it should be understood by those skilled in the art that the fluid flow control devices of the present invention are equally well suited for use in cased wells. Also, even though FIG. 1 depicts a string of fluid flow control devices, it should be understood by those skilled in the art that the fluid flow control devices of the present invention are equally well suited for use in wells that are divided into a plurality of intervals using packers or other sealing devices between adjacent fluid flow control devices or groups of fluid flow control devices.

In addition, even though FIG. 1 depicts the fluid flow control devices of the present invention in a horizontal section of the wellbore, it should be understood by those skilled in the art that the fluid flow control devices of the present invention are equally well suited for use in deviated or vertical wellbores. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Further, even though FIG. 1 depicts the fluid flow control devices of the present invention as including sand control screen elements, it should be understood by those skilled in the art that the fluid flow control devices of the present invention are equally well suited for use in completions that do not require sand control.

Figure 2:
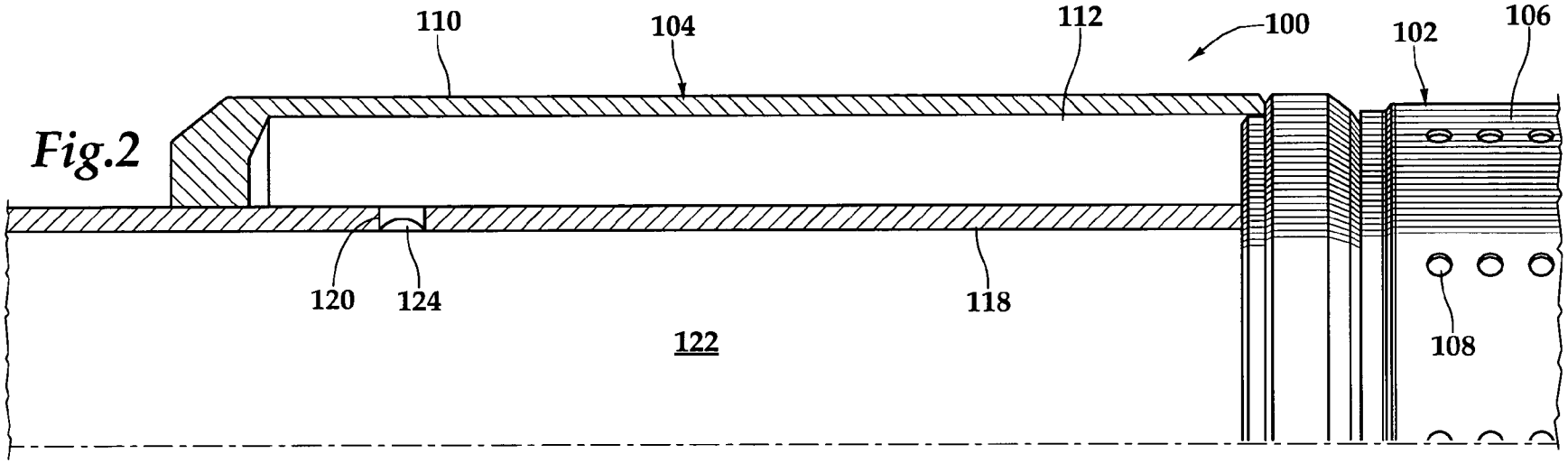
FIG. 2 is side view partially in quarter section of a fluid flow control device according to the present invention.

Referring next to FIG. 2, therein is depicted a fluid flow control device according to the present invention that is representatively illustrated and generally designated 100. Fluid flow control device 100 may be suitably coupled to other similar fluid flow control devices, seal assemblies, production tubulars or other downhole tools to form a tubing string as described above. Fluid flow control device 100 includes a sand control screen section 102 and a flow restrictor section 104. Sand control screen section 102 includes a suitable sand control screen element or filter medium, such as a wire wrap screen, a woven wire mesh screen or the like, designed to allow fluids to flow therethrough but prevent particulate matter of sufficient size from flowing therethrough. In the illustrated embodiment, a protective outer shroud 106 having a plurality of perforations 108 is positioned around the exterior of the filter medium.

Flow restrictor section 104 is configured in series with sand control screen section 102 such that production fluid must pass through sand control screen section 102 prior to entering flow restrictor section 104. Flow restrictor section 104 includes an outer housing 110. Outer housing 110 defines an annular chamber 112 with base pipe 118. Base pipe 118 includes an opening 120 that allow fluid flow between the exterior of base pipe 118 and an interior flow path 122 within base pipe 118. An actuatable device 124 is disposed within opening 120.

In operation, fluid flow control device 100 is installed within the well with actuatable device 124 in its unactuated configuration. In this configuration, no fluid is able to flow through fluid flow control device 100. In certain embodiments, actuatable device 124 may be a pressure actuated device that is actuated responsive to an increase in pressure to a predetermined level in interior flow path 122. For example, actuatable device 124 may be a rupture or burst disk that provides for one-time-use. In this case, a membrane of the rupture disk is engineered to fail at a fixed pressure such that exposing the membrane to such a pressure opens a passageway through the rupture disk. Use of such a rupture disk enables a single opening event and does not allow for resealing. It should be noted, however, by those skilled in the art that other types of actuatable devices may alternatively be used, such devices including, but not limited to, valves, sliding sleeves, removable plugs and the like. In addition, other methods of actuating a device or otherwise establishing communication through the base pipe can be used including, but not limited to, hydraulic control systems, electrical actuators, punch tools and the like. Once actuatable device 124 has been actuated, fluid flow through opening 120 and therefore fluid flow control device 100 is allowed. Accordingly, fluid flow control device 100 may be operated from a no flow configuration to a flow enabled configuration by actuating actuatable device 124.

Figure 3:
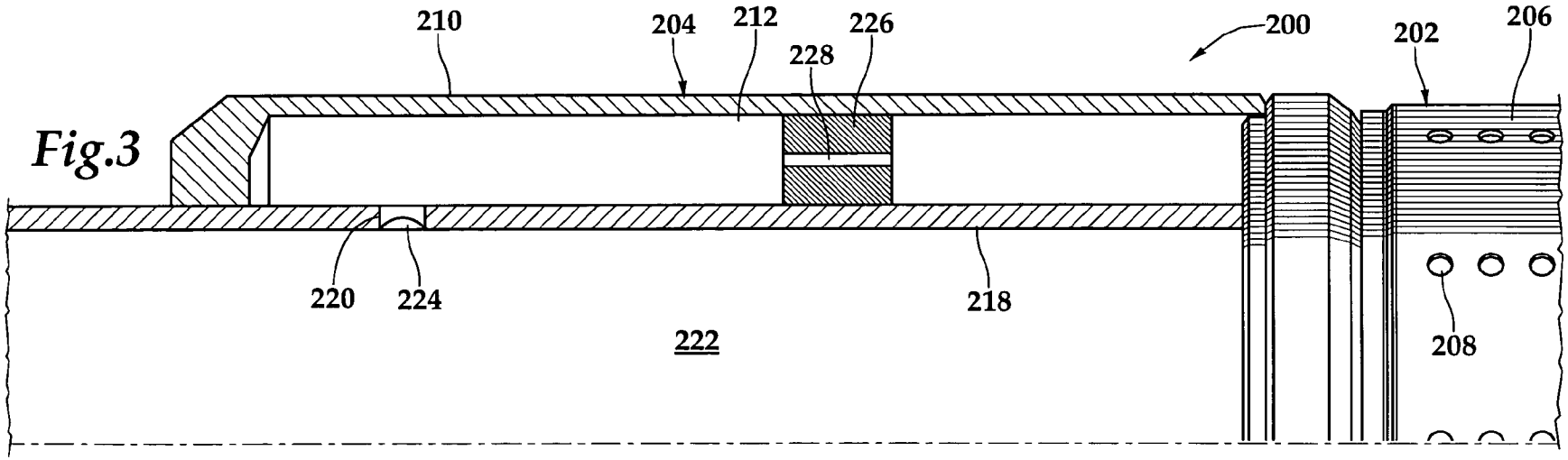
FIG. 3 is side view partially in quarter section of a fluid flow control device according to the present invention.

Referring next to FIG. 3, therein is depicted a fluid flow control device according to the present invention that is representatively illustrated and generally designated 200. Fluid flow control device 200 may be suitably coupled to other similar fluid flow control devices, seal assemblies, production tubulars or other downhole tools to form a tubing string as described above. Fluid flow control device 200 includes a sand control screen section 202 and a flow restrictor section 204. Sand control screen section 202 includes a suitable sand control screen element or filter medium. In the illustrated embodiment, a protective outer shroud 206 having a plurality of perforations 208 is positioned around the exterior of the filter medium.

Flow restrictor section 204 is configured in series with sand control screen section 202 such that production fluid must pass through sand control screen section 202 prior to entering flow restrictor section 204. Flow restrictor section 204 includes an outer housing 210. Outer housing 210 defines an annular chamber 212 with base pipe 218. Base pipe 218 includes an opening 220 that allows fluid flow between the exterior of base pipe 218 and an interior flow path 222 within base pipe 218. An actuatable device 224 is disposed within opening 220. A flow restricting device 226 is also disposed with annular chamber 212. Flow restricting device 226 includes a flow passageway 228 that creates a pressure drop in fluids that pass therethrough.

In operation, fluid flow control device 200 is installed within the well with actuatable device 224 in its unactuated configuration. In this configuration, no fluid is able to flow through fluid flow control device 200. Once actuatable device 224 has been actuated, fluid flow through opening 220 and therefore fluid flow control device 200 is allowed. In this embodiment, the fluid flowing from sand control screen section 202 to interior flow path 222 via opening 220 must pass through flow passageway 228 of flow restricting device 226. Flow passageway 228 is engineered to create a desired pressure drop in the fluids passing therethrough which also controls the flow rate at a given reservoir pressure. As discussed above, when a string of fluid flow control devices 200 extends from the heel to the toe of the well, establishing a suitable pressure drop in all such fluid flow control devices 200 will help to equalize the production profile along the length of the interval.

Figure 10A:
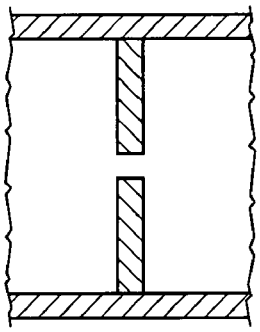
FIGS. 10A-E are cross sectional views of various embodiment of flow restricting devices for use in a fluid flow control device according to the present invention.
Figure 10B:
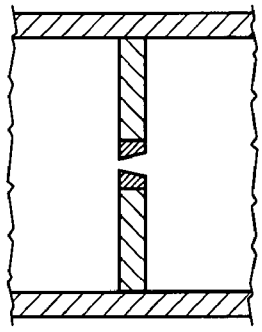
Figure 10C:
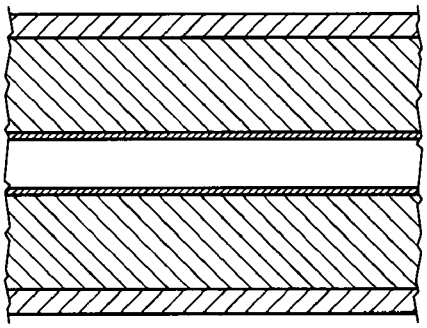
Figure 10D:
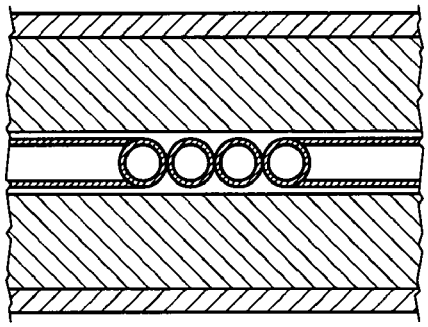
Figure 10E:
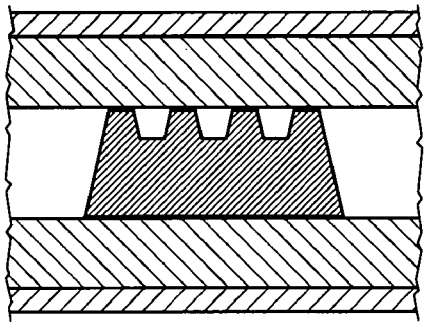

Even though flow restricting device 226 has been depicted with a tubular flow passageway 228, those skilled in the art with recognize that other types of flow restricting devices could alternative be used. For example, in addition to tubular flow passageways, as best seen in FIG. 10C, other suitable flow restricting devices include orifice plates, as best seen in FIG. 10A, nozzles, as best seen in FIG. 10B, coiled tubulars, as best seen in FIG. 10D, helical passageways, as best seen in FIG. 10E and the like may be used.

Figure 4:
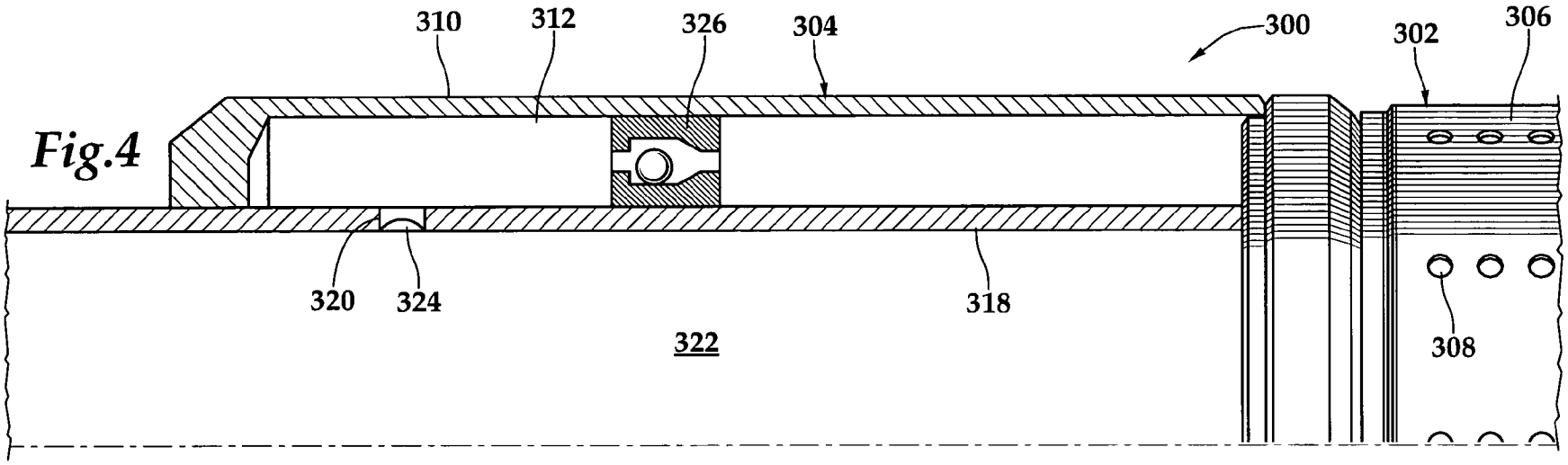
FIG. 4 is side view partially in quarter section of a fluid flow control device according to the present invention.

Referring next to FIG. 4, therein is depicted a fluid flow control device according to the present invention that is representatively illustrated and generally designated 300. Fluid flow control device 300 may be suitably coupled to other similar fluid flow control devices, seal assemblies, production tubulars or other downhole tools to form a tubing string as described above. Fluid flow control device 300 includes a sand control screen section 302 and a flow restrictor section 304. Sand control screen section 302 includes a suitable sand control screen element or filter medium. In the illustrated embodiment, a protective outer shroud 306 having a plurality of perforations 308 is positioned around the exterior of the filter medium.

Flow restrictor section 304 is configured in series with sand control screen section 302 such that production fluid must pass through sand control screen section 302 prior to entering flow restrictor section 304. Flow restrictor section 304 includes an outer housing 310. Outer housing 310 defines an annular chamber 312 with base pipe 318. Base pipe 318 includes an opening 320 that allows fluid flow between the exterior of base pipe 318 and an interior flow path 322 within base pipe 318. An actuatable device 324 is disposed within opening 320. A one way valve is disposed with annular chamber 312. One way valve 326 prevents fluid loss into the formation when pressure within interior flow path 322 exceeds that of the formation, for example when pressure is used to actuate actuatable device 324.

In operation, fluid flow control device 300 is installed within the well with actuatable device 324 in its unactuated configuration. In this configuration, no fluid is able to flow through fluid flow control device 300. Once actuatable device 324 has been actuated, fluid flow through opening 320 is allowed. In this embodiment, the fluid flow from interior flow path 322 to the formation is prevented by one way valve 326. This prevents fluid loss when pressure is used to actuate similar actuatable devices in this or other fluid flow control devices. When the actuation pressure is released, fluid flow from the formation to interior flow path 322 through one way valve 326 is allowed.

Figure 11A:
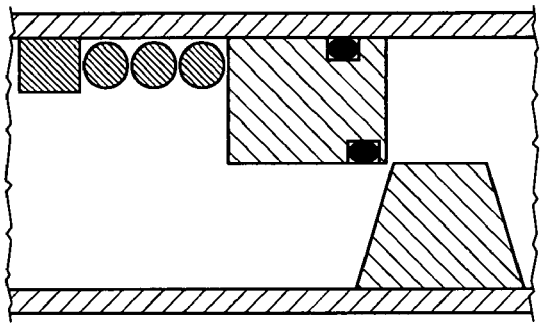
FIGS. 11A-F are cross sectional views of various embodiments of one way valves for use in a fluid flow control device according to the present invention.
Figure 11B:
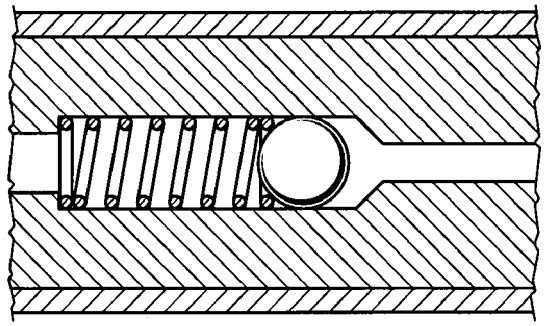
Figure 11C:
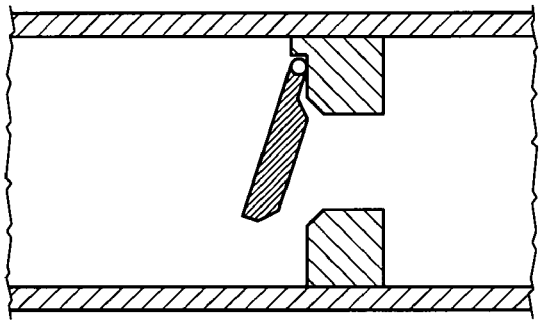
Figure 11D:
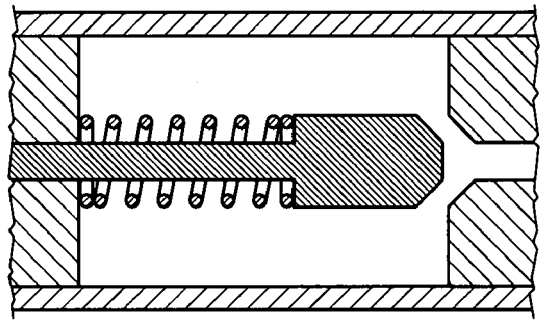
Figure 11E:
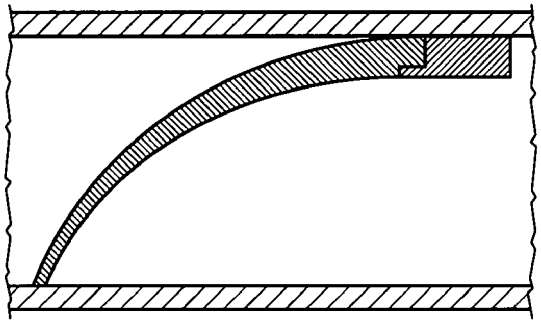
Figure 11F:
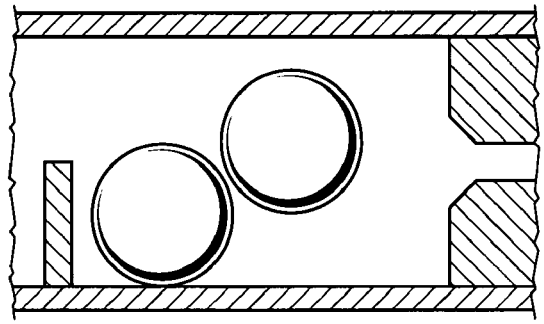

As should be understood by those skilled in the art a variety of different one way valve configurations may be suitable used in the flow restrictor section of the fluid flow control devices of the present invention. For example, a spring biased annular sleeve, as best seen in FIG. 11A, a spring biased ball and seat, as best seen in FIG. 11B, a pivoting gate, as best seen in FIG. 11C, a spring biased poppet and seat, as best seen in FIG. 11D, a resilient member that radially flexes, as best seen in FIG. 11E, a plurality of floating balls in an annular race and circumferentially spaced apart seats, as best seen in FIG. 11F and the like may be used. In addition, it should be understood by those skilled in the art that a one way valve could alternative be positioned in series with the actuatable device within the base pipe.

Figure 5:
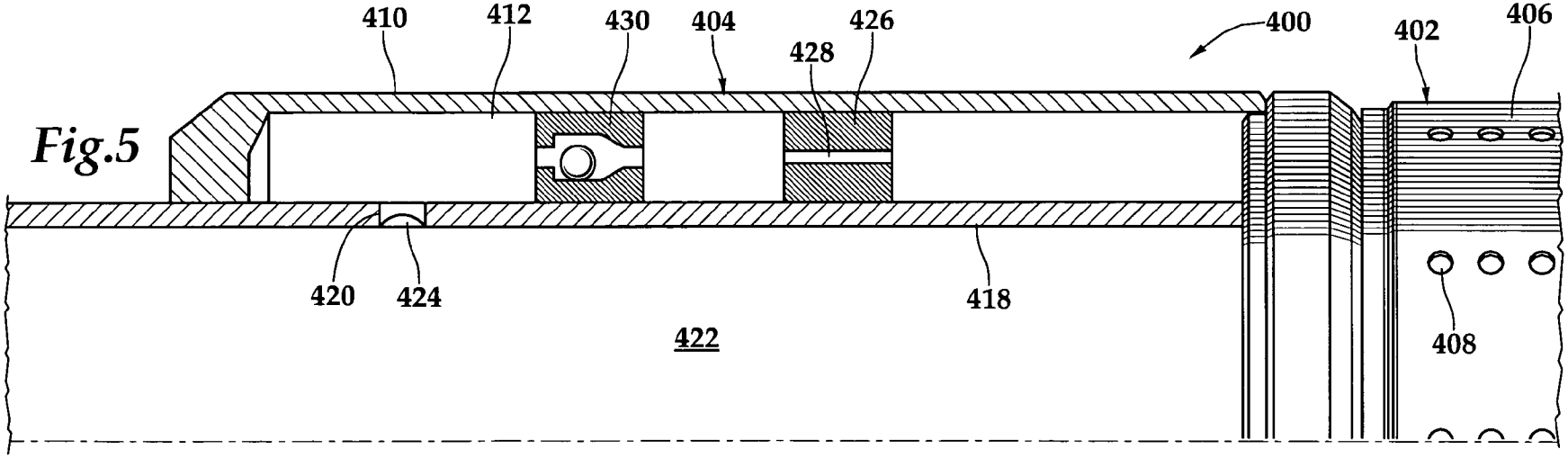
FIG. 5 is side view partially in quarter section of a fluid flow control device according to the present invention.

Referring next to FIG. 5, therein is depicted a fluid flow control device according to the present invention that is representatively illustrated and generally designated 400. Fluid flow control device 400 may be suitably coupled to other similar fluid flow control devices, seal assemblies, production tubulars or other downhole tools to form a tubing string as described above. Fluid flow control device 400 includes a sand control screen section 402 and a flow restrictor section 404. Sand control screen section 402 includes a suitable sand control screen element or filter medium. In the illustrated embodiment, a protective outer shroud 406 having a plurality of perforations 408 is positioned around the exterior of the filter medium.

Flow restrictor section 404 is configured in series with sand control screen section 402 such that production fluid must pass through sand control screen section 402 prior to entering flow restrictor section 404. Flow restrictor section 404 includes an outer housing 410. Outer housing 410 defines an annular chamber 412 with base pipe 418. Base pipe 418 includes an opening 420 that allows fluid flow between the exterior of base pipe 418 and an interior flow path 422 within base pipe 418. An actuatable device 424 is disposed within opening 420. A flow restricting device 426 is disposed with annular chamber 412. Flow restricting device 426 includes a flow passageway 428 that creates a pressure drop in fluids that pass therethrough. A one way valve 430 is disposed downstream of flow restricting device 426 within annular chamber 412. One way valve 430 prevents fluid loss into the formation when pressure within interior flow path 422 exceeds that of the formation, for example when pressure is used to actuate actuatable device 424 and other similar devices.

In operation, fluid flow control device 400 is installed within the well with actuatable device 424 in its unactuated configuration. In this configuration, no fluid is able to flow through fluid flow control device 400. Once actuatable device 424 has been actuated, fluid flow through opening 420 is allowed. In this embodiment, fluid loss from flow path 422 to the formation is prevented by one way valve 430. Fluid production from the formation to interior flow path 422 via opening 420 is allowed. This fluid flow must pass through flow passageway 428 of flow restricting device 426 which is engineered to create a desired pressure drop in the fluids passing therethrough which also controls the flow rate therethrough at a given reservoir pressure. As discussed above, when a string of fluid flow control devices 400 extends from the heel to the toe of the well, establishing a suitable pressure drop in all of such fluid flow control devices 400 will help to equalize the production profile along the length of the interval.

Figure 6:
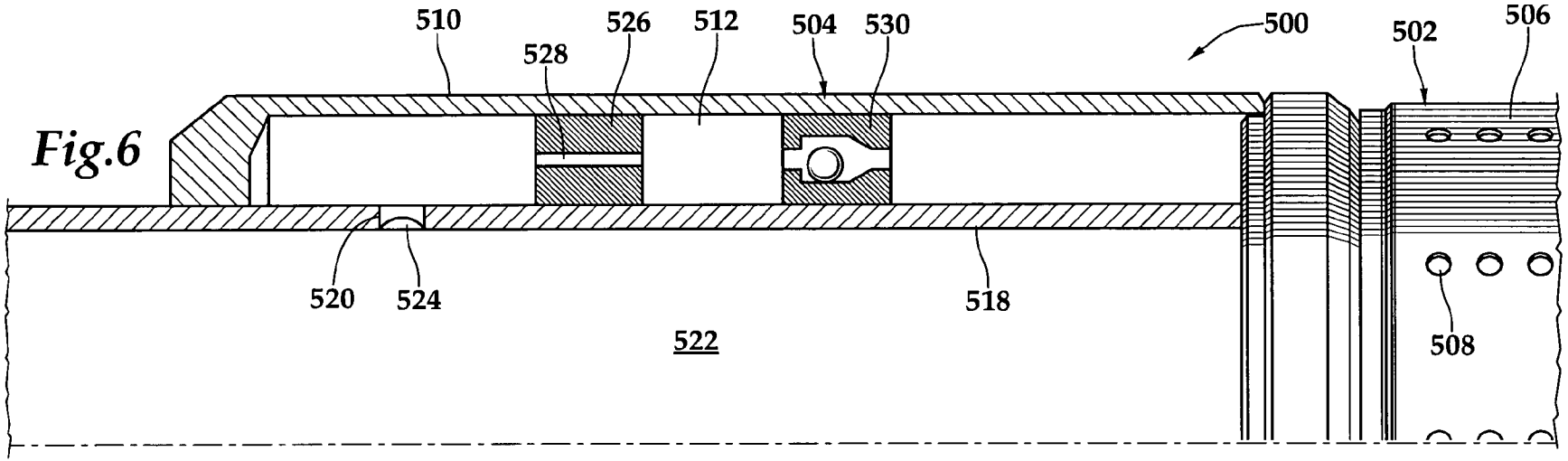
FIG. 6 is side view partially in quarter section of a fluid flow control device according to the present invention.

Referring next to FIG. 6, therein is depicted a fluid flow control device according to the present invention that is representatively illustrated and generally designated 500. Fluid flow control device 500 may be suitably coupled to other similar fluid flow control devices, seal assemblies, production tubulars or other downhole tools to form a tubing string as described above. Fluid flow control device 500 includes a sand control screen section 502 and a flow restrictor section 504. Sand control screen section 502 includes a suitable sand control screen element or filter medium. In the illustrated embodiment, a protective outer shroud 506 having a plurality of perforations 508 is positioned around the exterior of the filter medium.

Flow restrictor section 504 is configured in series with sand control screen section 502 such that production fluid must pass through sand control screen section 502 prior to entering flow restrictor section 504. Flow restrictor section 504 includes an outer housing 510. Outer housing 510 defines an annular chamber 512 with base pipe 518. Base pipe 518 includes an opening 520 that allows fluid flow between the exterior of base pipe 518 and an interior flow path 522 within base pipe 518. An actuatable device 524 is disposed within opening 520. A flow restricting device 526 is disposed with annular chamber 512. Flow restricting device 526 includes a flow passageway 528 that creates a pressure drop in fluids that pass therethrough. A one way valve 530 is disposed upstream of flow restricting device 526 within annular chamber 512. One way valve 530 prevents fluid loss into the formation when pressure within interior flow path 522 exceeds that of the formation, for example when pressure is used to actuate actuatable device 524 and other similar devices.

In operation, fluid flow control device 500 is installed within the well with actuatable device 524 in its unactuated configuration. In this configuration, no fluid is able to flow through fluid flow control device 500. Once actuatable device 524 has been actuated, fluid flow through opening 520 is allowed. In this embodiment, fluid loss from flow path 522 to the formation is prevented by one way valve 530. Fluid production from the formation to interior flow path 522 via opening 520 is allowed. This fluid flow must pass through flow passageway 528 of flow restricting device 526 which is engineered to create a desired pressure drop in the fluids passing therethrough which also controls the flow rate therethrough at a given reservoir pressure. As discussed above, when a string of fluid flow control devices 500 extends from the heel to the toe of the well, establishing a suitable pressure drop in all of such fluid flow control devices 500 will help to equalize the production profile along the length of the interval.

Figure 7:
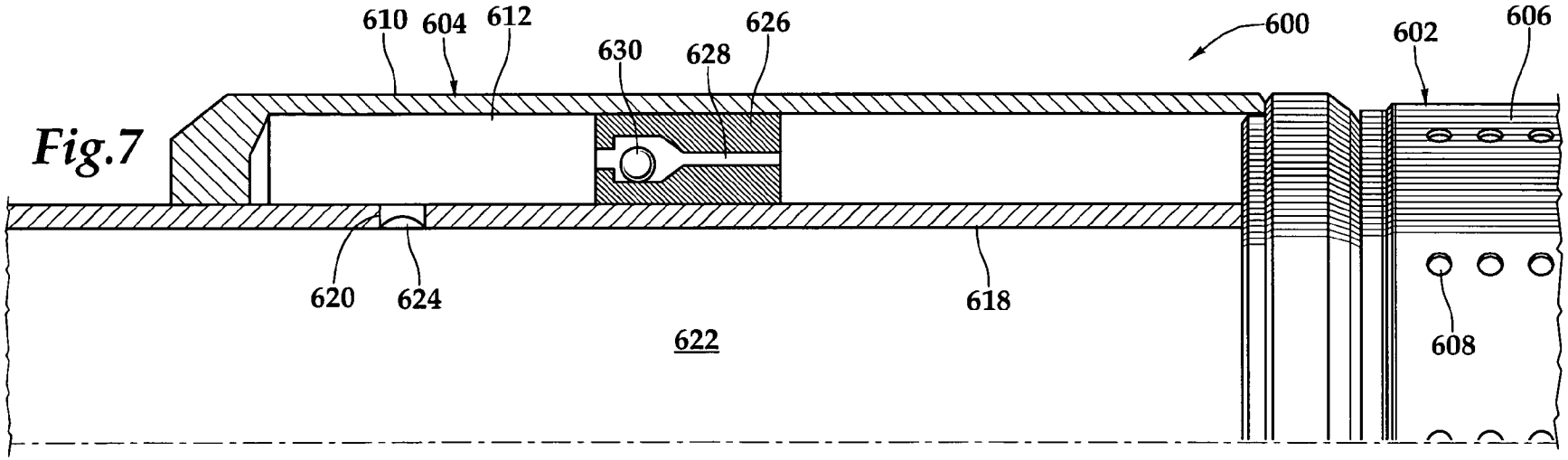
FIG. 7 is side view partially in quarter section of a fluid flow control device according to the present invention.

Referring next to FIG. 7, therein is depicted a fluid flow control device according to the present invention that is representatively illustrated and generally designated 600. Fluid flow control device 600 may be suitably coupled to other similar fluid flow control devices, seal assemblies, production tubulars or other downhole tools to form a tubing string as described above. Fluid flow control device 600 includes a sand control screen section 602 and a flow restrictor section 604. Sand control screen section 602 includes a suitable sand control screen element or filter medium. In the illustrated embodiment, a protective outer shroud 606 having a plurality of perforations 608 is positioned around the exterior of the filter medium.

Flow restrictor section 604 is configured in series with sand control screen section 602 such that production fluid must pass through sand control screen section 602 prior to entering flow restrictor section 604. Flow restrictor section 604 includes an outer housing 610. Outer housing 610 defines an annular chamber 612 with base pipe 618. Base pipe 618 includes an opening 620 that allows fluid flow between the exterior of base pipe 618 and an interior flow path 622 within base pipe 618. An actuatable device 624 is disposed within opening 620. A flow restricting device 626 is disposed with annular chamber 612. Flow restricting device 626 includes a flow passageway 628 that creates a pressure drop in fluids that pass therethrough. Flow restricting device 626 also includes an integral one way valve 630. One way valve 630 prevents fluid loss into the formation when pressure within interior flow path 622 exceeds that of the formation, for example when pressure is used to actuate actuatable device 624 and other similar devices.

In operation, fluid flow control device 600 is installed within the well with actuatable device 624 in its unactuated configuration. In this configuration, no fluid is able to flow through fluid flow control device 600. Once actuatable device 624 has been actuated, fluid flow through opening 620 is allowed. In this embodiment, fluid loss from flow path 622 to the formation is prevented by one way valve 630. Fluid production from the formation to interior flow path 622 via opening 620 is allowed. This fluid flow must pass through flow passageway 628 of flow restricting device 626 which is engineered to create a desired pressure drop in the fluids passing therethrough which also controls the flow rate therethrough at a given reservoir pressure. As discussed above, when a string of fluid flow control devices 600 extends from the heel to the toe of the well, establishing a suitable pressure drop in all of such fluid flow control devices 600 will help to equalize the production profile along the length of the interval.

Figure 8:
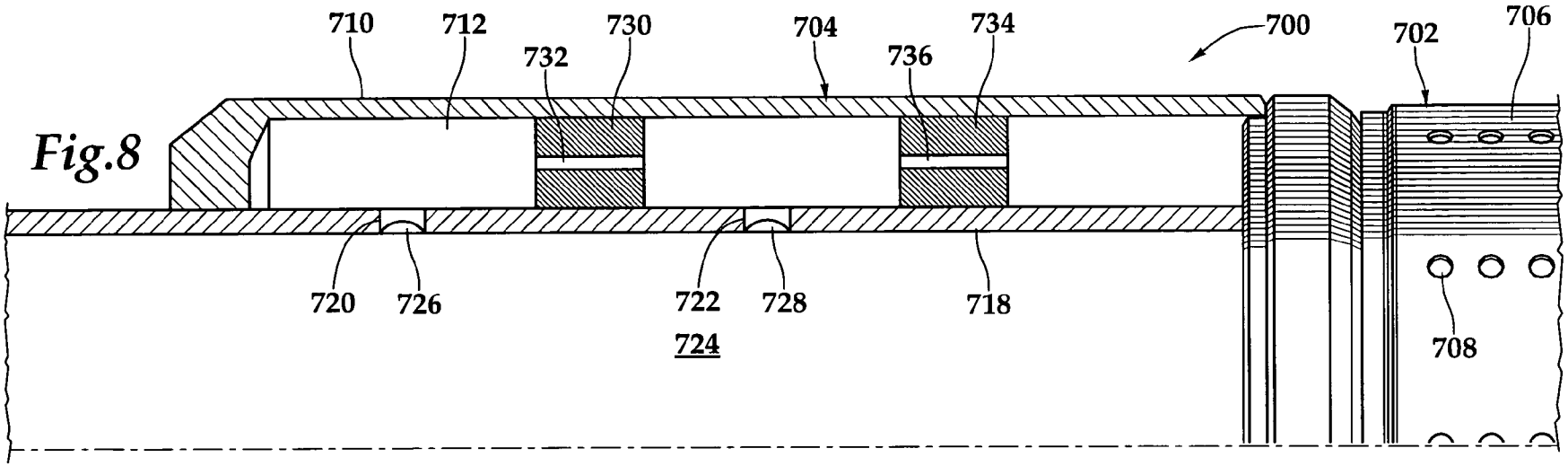
FIG. 8 is side view partially in quarter section of a fluid flow control device according to the present invention.

Referring next to FIG. 8, therein is depicted a fluid flow control device according to the present invention that is representatively illustrated and generally designated 700. Fluid flow control device 700 may be suitably coupled to other similar fluid flow control devices, seal assemblies, production tubulars or other downhole tools to form a tubing string as described above. Fluid flow control device 700 includes a sand control screen section 702 and a flow restrictor section 704. Sand control screen section 702 includes a suitable sand control screen element or filter medium. In the illustrated embodiment, a protective outer shroud 706 having a plurality of perforations 708 is positioned around the exterior of the filter medium.

Flow restrictor section 704 is configured in series with sand control screen section 702 such that production fluid must pass through sand control screen section 702 prior to entering flow restrictor section 704. Flow restrictor section 704 includes an outer housing 710. Outer housing 710 defines an annular chamber 712 with base pipe 718. Base pipe 718 includes an opening 720 and an opening 722 that allow fluid flow between the exterior of base pipe 718 and an interior flow path 724 within base pipe 718. An actuatable device 726 is disposed within opening 720 and an actuatable device 728 is disposed within opening 722. A flow restricting device 730 is disposed with annular chamber 712. Flow restricting device 730 includes a flow passageway 732 that creates a pressure drop in fluids that pass therethrough. In addition, a flow restricting device 734 is disposed with annular chamber 712. Flow restricting device 734 includes a flow passageway 736 that creates a pressure drop in fluids that pass therethrough.

In certain operations, fluid flow control device 700 is installed within the well with actuatable devices 726 and 728 in their unactuated configurations. In this configuration, no fluid is able to flow through fluid flow control device 700. Thereafter, actuatable device 726 may be actuated downhole to establish fluid communication therethrough. Alternatively, fluid flow control device 700 may be installed within the well with actuatable device 726 removed or otherwise disabled. In either installed configuration, once fluid flow through opening 720 is enabled, the fluid flowing from sand control screen section 702 to interior flow path 724 via opening 720 must pass through flow restricting device 734 and flow restricting device 730. Each of flow restricting device 734 and flow restricting device 730 is engineered to create a desired pressure drop in the fluids passing therethrough, which also controls the flow rate therethrough at a given reservoir pressure. As discussed above, when a string of fluid flow control devices 700 extends from the heel to the toe of the well, establishing a suitable pressure drop in all of such fluid flow control devices 700 will help to equalize the production profile along the length of the interval.

As the reservoir becomes depleted and the reservoir pressure declines, the pressure drop created by flow restricting device 734 together with flow restricting device 730 may no longer be desirable. In the present embodiment, the pressure drop associated with fluid flow control device 700 can be adjusted to enhance the ultimate recovery from the reservoir. Specifically, when it is desired to reduced the pressure drop through fluid flow control device 700, actuatable device 728 may be actuated downhole to establish fluid communication through opening 722. In this configuration, the fluid flowing from sand control screen section 702 to interior flow path 724 now passes through flow restricting device 734 and opening 722 bypassing flow restricting device 730 and the pressure drop associated therewith. Accordingly, this embodiment allows for the reduction in the pressure drop experienced by fluids passing therethrough by establishing a fluid pathway that bypasses flow restricting device 730.

Figure 9:
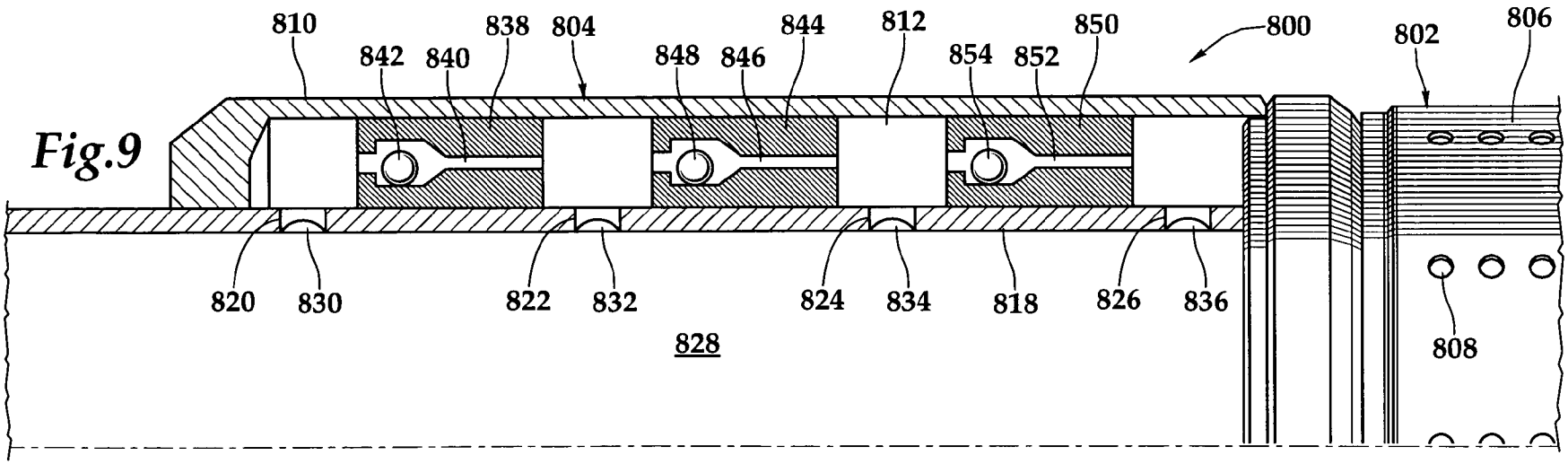
FIG. 9 is side view partially in quarter section of a fluid flow control device according to the present invention.

Referring next to FIG. 9, therein is depicted a fluid flow control device according to the present invention that is representatively illustrated and generally designated 800. Fluid flow control device 800 may be suitably coupled to other similar fluid flow control devices, seal assemblies, production tubulars or other downhole tools to form a tubing string as described above. Fluid flow control device 800 includes a sand control screen section 802 and a flow restrictor section 804. Sand control screen section 802 includes a suitable sand control screen element or filter medium. In the illustrated embodiment, a protective outer shroud 806 having a plurality of perforations 808 is positioned around the exterior of the filter medium.

Flow restrictor section 804 is configured in series with sand control screen section 802 such that production fluid must pass through sand control screen section 802 prior to entering flow restrictor section 804. Flow restrictor section 804 includes an outer housing 810. Outer housing 810 defines an annular chamber 812 with base pipe 818. Base pipe 818 includes a plurality of openings 820, 822, 824, 826 that allow fluid flow between the exterior of base pipe 818 and an interior flow path 828 within base pipe 818. Each of opening 820, 822, 824, 826 has an actuatable device 830, 832, 834, 836 respectively disposed therein. A flow restricting device 838 is disposed with annular chamber 812. Flow restricting device 838 includes a flow passageway 840 that creates a pressure drop in fluids that pass therethrough and an integral one way valve 842 that prevents fluid loss into the formation. In addition, a flow restricting device 844 is disposed with annular chamber 812. Flow restricting device 844 includes a flow passageway 846 that creates a pressure drop in fluids that pass therethrough and an integral one way valve 848 that prevents fluid loss into the formation. Further, a flow restricting device 850 is disposed with annular chamber 812. Flow restricting device 850 includes a flow passageway 852 that creates a pressure drop in fluids that pass therethrough and an integral one way valve 854 that prevents fluid loss into the formation.

In certain operations, fluid flow control device 800 is installed within the well with each of actuatable devices 830, 832, 834, 836 in their unactuated configuration. In this configuration, no fluid is able to flow through fluid flow control device 800. Alternatively, fluid flow control device 800 may be installed within the well with actuatable device 830 removed or otherwise disabled. In either installed configuration, once fluid flow through opening 820 is enabled, the fluid flowing from sand control screen section 802 to interior flow path 828 via opening 820 must pass through each of flow restricting devices 838, 844, 850, each of which is engineered to create a desired pressure drop in the fluids passing therethrough and control the flow rate therethrough at a given reservoir pressure. As discussed above, when a string of fluid flow control devices 800 extends from the heel to the toe of the well, establishing a suitable pressure drop in all of such fluid flow control devices 800 will help to equalize the production profile along the length of the interval.

As the reservoir becomes depleted and the reservoir pressure declines, the pressure drop created by flow restricting devices 838, 844, 850 may no longer be desirable. In the present embodiment, the pressure drop associated with fluid flow control device 800 can be adjusted. Specifically, when it is desired to reduced the pressure drop through fluid flow control device 800, actuatable device 832 may be actuated downhole to establish fluid communication through opening 822. This actuation may be achieved by pressuring up interior flow path 828 to a predetermined first level. During this pressuring up phase, fluid loss into the formation is prevented by one way valve 842.

Once communication through opening 822 is established, the fluid flowing from sand control screen section 802 to interior flow path 828 now passes through flow restricting devices 844, 850 and opening 822 bypassing flow restricting device 838 and the pressure drop associated therewith. Accordingly, this embodiment allows for the reduction in the pressure drop experienced by fluids passing therethrough by establishing a fluid pathway that bypasses flow restricting device 838.

As the reservoir becomes further depleted, the pressure drop created by flow restricting devices 844, 850 may no longer be desirable. In the present embodiment, the pressure drop associated with fluid flow control device 800 can be again adjusted. Specifically, when it is desired to reduced the pressure drop through fluid flow control device 800, actuatable device 834 may be actuated downhole to establish fluid communication through opening 824. This actuation may be achieved by pressuring up interior flow path 828 to a predetermined second level that is higher than the first level. During this pressuring up phase, fluid loss into the formation is prevented by one way valve 848.

Once communication through opening 824 is established, the fluid flowing from sand control screen section 802 to interior flow path 828 now passes through flow restricting device 850 and opening 824 bypassing flow restricting devices 838, 844 and the pressure drops associated therewith. Accordingly, this embodiment allows for the reduction in the pressure drop experienced by fluids passing therethrough by establishing a fluid pathway that bypasses flow restricting devices 838, 844.

As the reservoir becomes even further depleted, the pressure drop created by flow restricting device 850 may no longer be desirable. In the present embodiment, the pressure drop associated with fluid flow control device 800 can be further adjusted. Specifically, when it is desired to reduced the pressure drop through fluid flow control device 800, actuatable device 836 may be actuated downhole to establish fluid communication through opening 826. This actuation may be achieved by pressuring up interior flow path 828 to a predetermined third level that is higher than the second level. During this pressuring up phase, fluid loss into the formation is prevented by one way valve 854.

Once communication through opening 826 is established, the fluid flowing from sand control screen section 802 to interior flow path 828 now passes through opening 826 bypassing all of the flow restricting devices and the pressure drops associated therewith. Accordingly, this embodiment allows for the progressive reduction in the pressure drop experienced by fluids passing therethrough by establishing fluid pathways that sequentially bypass additional ones of the flow restricting devices.

Figure 12C:
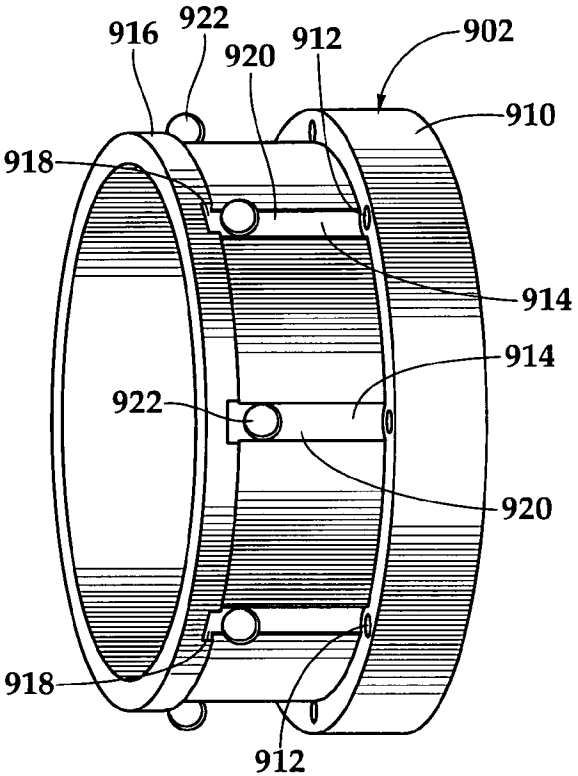
FIGS. 12A-C are views of one embodiment of an annular one way valve having a plurality of flow paths therethrough that may be used in a fluid flow control device according to the present invention.
Figure 12B:
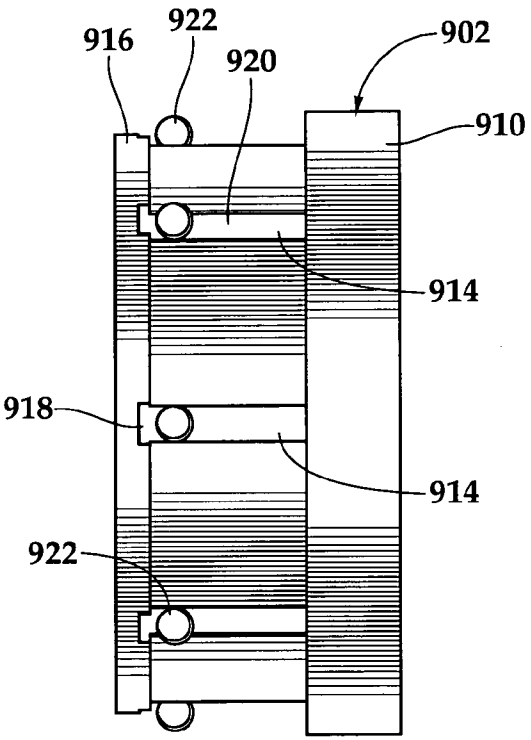
Figure 12A:
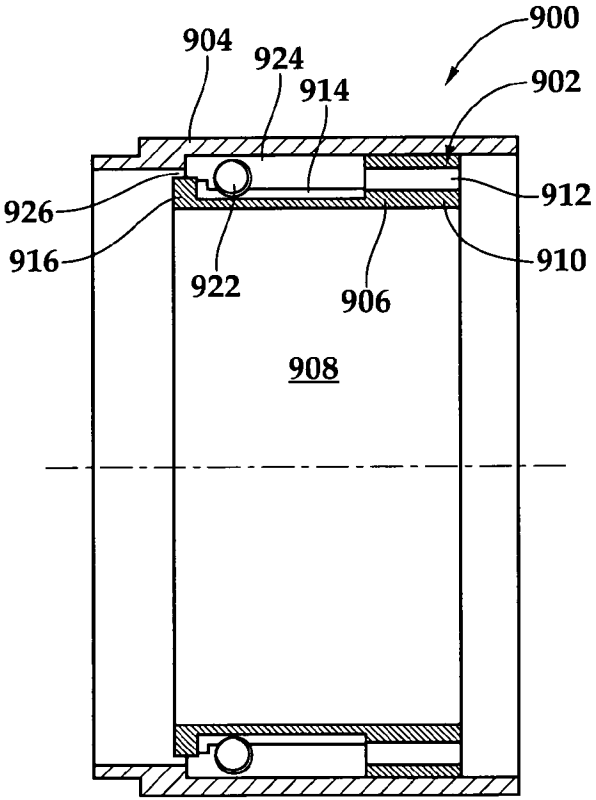

Referring now to FIGS. 12A-C, therein are depicted various views of an annular one way valve having a plurality of flow paths therethrough that is generally designated 900. Annular one way valve 900 may be used in any of the above described fluid flow control devices in conjunction with or as an alternative to any of the one way valves described above such as the one way valves depicted in FIGS. 11A-F. Annular one way valve 900 include a ball cage 902 that is disposed within an outer housing 904 such as the outer housings of the fluid flow control devices described above. Ball cage 902 includes a substantially tubular member 906 that, along with other portions of the base pipe described above, defines an internal flow passageway 908. Ball cage 902 includes a radially outwardly extending annular flange 910 having a plurality of passageways 912 extending longitudinally therethrough. As illustrated, there are eight passageways 912, only some of which are visible in the various views. It should be understood by those skilled in the art that other numbers of passageways both greater than and less than eight could alternatively be used.

Formed within the outer surface of tubular member 906 are a plurality of longitudinally extending slots 914. Each slot 914 circumferentially corresponds to one of the passageways 912. Ball cage 902 includes a radially outwardly extending annular retainer flange 916 having a plurality of notches 918 formed therein. Each notch 918 circumferentially corresponds to one of the slots 914. Together, corresponding notches 918 and slots 914 form tracks 920. Disposed within each of the tracks 920 is a ball 922. When ball cage 902 is disposed within housing 904 as depicted in FIG. 12A, each ball 922 is retained within its corresponding track 920 such that the balls are allowed to travel longitudinally within annular region 924 but are prevented from traveling circumferentially within annular region 924 beyond the width of the corresponding track 920. Accordingly, a corresponding one-to-one relationship is created between balls 922 and passageways 912.

In operation, balls 922 move within tracks 920 in response to pressure difference between passageways 912 and annular passageway 926 that is selectively in fluid communication with internal flow passageway 908. For example, fluid communication between annular passageway 926 and internal flow passageway 908 may be prevented in a manner similar to that described above with reference to actuatable devices disposed within openings of a base pipe, such as actuatable device 324 within opening 320 of base pipe 318. Likewise, fluid communication between annular passageway 926 and internal flow passageway 908 may be allowed by actuating such an actuatable device. When annular passageway 926 is in fluid communication with internal flow passageway 908 and the pressure in internal flow passageway 908 is less than the pressure at passageways 912, fluid flow through one way valve 900 from upstream of passageways 912 to internal flow passageway 908 is allowed as balls 922 are remote from passageways 912. When annular passageway 926 is in fluid communication with internal flow passageway 908 and the pressure in internal flow passageway 908 is greater than the pressure at passageways 912, fluid flow through one way valve 900 toward passageways 912 from internal flow passageway 908 is disallowed as balls 922 seat within passageways 912. Accordingly, one way valve 900 provides reliable flow control by selective allowing and preventing fluid flow therethrough which, when used within one of the fluid flow control devices described above, prevents fluid loss into a formation from internal flow passageway 908 but allows production from the formation into internal flow passageway 908.

Even though tracks 920 have been depicted as being formed by slots 914 within the outer surface of tubular member 906 and notches 918 in annular retainer flange 916, it should be understood by those skilled in the art that tracks 920 can take other configurations, such configuration also being considered within the scope of the present invention. For example, radially outwardly extending longitudinal rails or other structures attached to the outer surface of tubular member 906 may be used to form tracks 920 above the outer surface of tubular member 906 such that corresponding balls 922 are prevented from traveling circumferentially within annular region 924 beyond the rails.

Figures 13A, 13B, 13C:
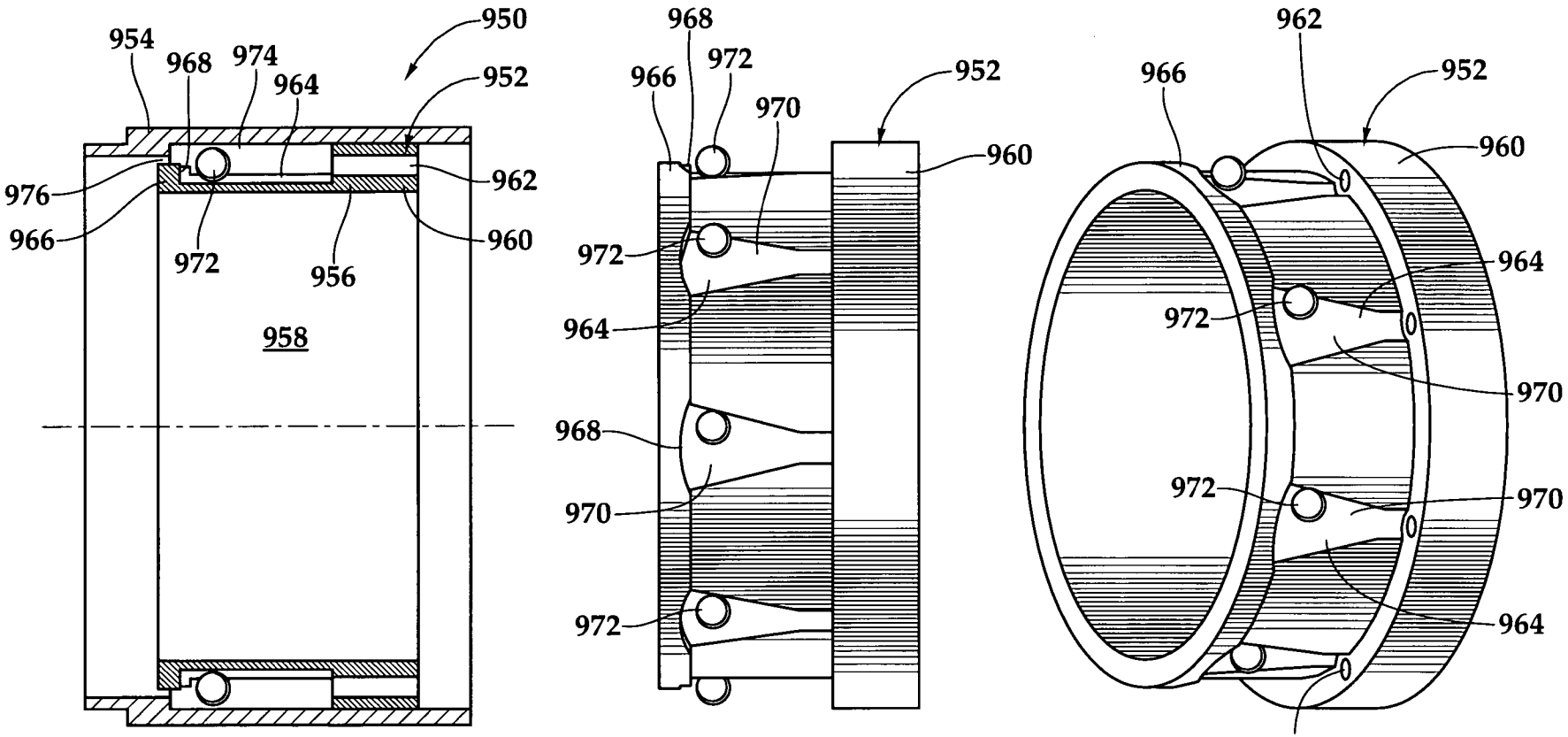
FIGS. 13A-C are views of another embodiment of an annular one way valve having a plurality of flow paths therethrough that may be used in a fluid flow control device according to the present invention.

Referring now to FIGS. 13A-C, therein are depicted various views of an annular one way valve having a plurality of flow paths therethrough that is generally designated 950. Annular one way valve 950 may be used in any of the above described fluid flow control devices in conjunction with or as an alternative to any of the one way valves described above such as the one way valves depicted in FIGS. 11A-F. Annular one way valve 950 include a ball cage 952 that is disposed within an outer housing 954 such as the outer housings of the fluid flow control devices described above. Ball cage 952 includes a substantially tubular member 956 that, along with other portions of the base pipe described above, defines an internal flow passageway 958. Ball cage 952 includes a radially outwardly extending annular flange 960 having a plurality of passageways 962 extending longitudinally therethrough. As illustrated, there are eight passageways 962, only some of which are visible in the various views. It should be understood by those skilled in the art that other numbers of passageways both greater than and less than eight could alternatively be used.

Formed within the outer surface of tubular member 956 are a plurality of longitudinally extending slots 964. Each slot 964 circumferentially corresponds to one of the passageways 962. Ball cage 952 includes a radially outwardly extending annular retainer flange 966 having a plurality of notches 968 formed therein. Each notch 968 circumferentially corresponds to one of the slots 964. Together, corresponding notches 968 and slots 964 form tracks 970. Disposed within each of the tracks 970 is a ball 972. When ball cage 952 is disposed within housing 954 as depicted in FIG. 13A, each ball 972 is retained within its corresponding track 970 such that the balls are allowed to travel longitudinally within annular region 974 but prevented from traveling circumferentially within annular region 974 beyond the width of the corresponding track 970. Accordingly, a corresponding one-to-one relationship is created between balls 972 and passageways 962.

In operation, balls 972 move within tracks 970 in response to pressure difference between passageways 962 and an annular passageway 976 that is selectively in fluid communication with internal flow passageway 958. For example, fluid communication between annular passageway 976 and internal flow passageway 958 may be prevented in a manner similar to that described above with reference to actuatable devices disposed within openings of a base pipe, such as actuatable device 324 within opening 320 of base pipe 318. Likewise, fluid communication between annular passageway 976 and internal flow passageway 958 may be allowed by actuating such an actuatable device. When annular passageway 976 is in fluid communication with internal flow passageway 958 and the pressure in internal flow passageway 958 is less than the pressure at passageways 962, fluid flow through one way valve 950 from upstream of passageways 962 to internal flow passageway 958 is allowed as balls 972 are remote from passageways 962. In this embodiment, tracks 970 allow balls 972 to move a limited circumferentially distance which reduces the flow restriction through one way valve 950 as compared to one way valve 900 described above as balls 972 are no longer in the direct flowpath of fluids flowing therethrough. Likewise, allowing such limited circumferentially travel of balls 972 within tracks 970 reduces erosion of balls 972 which could otherwise reduce the sealing capability of balls 972. When annular passageway 976 is in fluid communication with internal flow passageway 958 and the pressure in internal flow passageway 958 is greater than the pressure at passageways 962, fluid flow through one way valve 950 toward passageways 962 from internal flow passageway 958 is disallowed as balls 972 seat within passageways 962. Accordingly, one way valve 950 provides reliable flow control by selective allowing and preventing fluid flow therethrough which, when used within one of the fluid flow control devices described above, prevents fluid loss into a formation from internal flow passageway 958 but allows production from the formation into internal flow passageway 958.

Even though tracks 970 have been depicted as being formed by slots 964 within the outer surface of tubular member 956 and notches 968 in annular retainer flange 966, it should be understood by those skilled in the art that tracks 970 can take other configurations, such configuration also being considered within the scope of the present invention. For example, radially outwardly extending longitudinal rails or other structures attached to the outer surface of tubular member 956 may be used to form tracks 970 above the outer surface of tubular member 956 such that corresponding balls 972 are prevented from traveling circumferentially within annular region 974 beyond the rails.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen comprising:

a base pipe having first, second, third and fourth openings that allow fluid flow between an exterior of the base pipe and an interior flow path of the base pipe;

a filter medium disposed exteriorly of the base pipe;

a flow restricting section disposed exteriorly of the base pipe, the flow restricting section including first, second and third flow restricting devices that respectively create first, second and third pressure drops in fluids flowing therethrough, the first flow restricting device providing a first flow path between the filter medium and the interior flow path via the first opening, the first and second flow restricting devices providing a second flow path between the filter medium and the interior flow path via the second opening, the first, second and third flow restricting devices providing a third flow path between the filter medium and the interior flow path via the third opening; and actuatable devices operably associated with at least the first, second and fourth openings, the actuatable device operably associated with the second opening initially prevents fluid flow through the second opening and is actuatable to allow fluid flow through the second opening, thereby transitioning the fluid flow from the third flow path to the second flow path, the actuatable device operably associated with the first opening initially prevents fluid flow through the first opening and is actuatable to allow fluid flow through the first opening, thereby transitioning the fluid flow from the second flow path to the first flow path and the actuatable device operably associated with the fourth opening initially prevents fluid flow through the fourth opening and is actuatable to allow fluid flow through the fourth opening to provide a fourth flow path that bypasses the first, second and third flow restricting devices.

2. The sand control screen as recited in claim 1 wherein the actuatable devices further comprise pressure actuated devices that are sequentially actuatable responsive to sequentially increasing predetermined pressure levels in the interior flow path.

3. The sand control screen as recited in claim 1 further comprising a one way valve disposed in the flow restricting section to prevent fluid flow from the flow restricting section to the filter medium.

4. The sand control screen as recited in claim 1 further comprising an actuatable device operably associated with the third opening that is operable to initially prevent fluid flow through the third opening and actuatable to allow fluid flow through the third opening.

5. The sand control screen as recited in claim 1 wherein each of the flow restricting devices further comprises a one way valve that prevents fluid flow from the flow restricting section to the filter medium.

6. A flow control apparatus for controlling the inflow of production fluids from a subterranean well, the flow control apparatus comprising:

a tubular member having a plurality of openings that allow fluid flow between an exterior of the tubular member and an interior flow path of the tubular member;

a multi-stage flow restricting section operably positioned in a fluid flow path between a fluid source disposed exteriorly of the tubular member and the interior flow path, the flow restricting section including a plurality of flow restricting devices each operable to create a pressure drop and each associated with one of the openings creating a plurality of flow paths between the fluid source and the interior flow path via the respective openings; and actuatable devices operably associated with at least some of the openings that initially prevent fluid flow through the associated opening and are actuatable to allow fluid flow through the associated opening to sequentially reduce the pressure drop experienced by fluids flowing from the fluid source to the interior flow path, wherein at least one of the actuatable devices is actuatable to allow fluid flow through at least one of the openings to create a fluid flow path that bypasses the plurality of flow restricting devices.

7. The flow control apparatus as recited in claim 6 wherein the actuatable devices further comprise pressure actuated devices that are sequentially actuatable responsive to sequentially increasing predetermined pressure levels in the interior flow path.

8. The flow control apparatus as recited in claim 6 wherein at least some of the flow restricting devices further comprise a one way valve that prevents fluid flow from the flow restricting section to the fluid source.

9. The flow control apparatus as recited in claim 6 further comprising a filter medium disposed exteriorly of the tubular member between the fluid source and the multi-stage flow restricting section.

10. A sand control screen positionable within a wellbore, the sand control screen comprising:

a base pipe having at least one opening that allows fluid flow between an exterior of the base pipe and an interior flow path of the base pipe;

a filter medium positioned exteriorly of the base pipe, the filter medium selectively allowing fluid flow therethrough and preventing particulate flow of a predetermined size therethrough;

a flow restricting device and a one way valve disposed in a fluid flow path between the filter medium and the at least one opening, the flow restricting device operable to create a pressure drop in fluids flowing therethrough, the one way valve operable to allow fluid flow in a downstream direction from the filter medium to the at least one opening and prevent fluid flow in an upstream direction from the at least one opening to the filter medium, the flow restricting device positioned downstream of the one way valve; and a pressure actuated device operably associated with the at least one opening, the pressure actuated device operable to initially prevent fluid flow through the at least one opening and actuatable to allow fluid flow through the at least one opening responsive to an increase in pressure to a predetermined level in the interior flow path.

11. The sand control screen as recited in claim 10 wherein the pressure operated device further comprises a rupture disk.

12. A sand control screen positionable within a wellbore, the sand control screen comprising:

a base pipe having at least one opening that allows fluid flow between an exterior of the base pipe and an interior flow path of the base pipe;

a filter medium positioned exteriorly of the base pipe, the filter medium selectively allowing fluid flow therethrough and preventing particulate flow of a predetermined size therethrough;

a flow restricting device and a one way valve disposed in a fluid flow path between the filter medium and the at least one opening, the flow restricting device operable to create a pressure drop in fluids flowing therethrough, the one way valve operable to allow fluid flow in a downstream direction from the filter medium to the at least one opening and prevent fluid flow in an upstream direction from the at least one opening to the filter medium, the flow restricting device and the one way valve being integrally formed; and a pressure actuated device operably associated with the at least one opening, the pressure actuated device operable to initially prevent fluid flow through the at least one opening and actuatable to allow fluid flow through the at least one opening responsive to an increase in pressure to a predetermined level in the interior flow path.

13. The sand control screen as recited in claim 12 wherein the pressure operated device further comprises a rupture disk.

* * * * *